US005919389A

United States Patent [19]

Uehashi et al.

[11] Patent Number: 5,919,389

[45] Date of Patent: Jul. 6, 1999

[54] COOKING APPARATUS INCLUDING INFRARED RAY SENSOR

[75] Inventors: Hiroyuki Uehashi; Kazuo Taino; Kazuyuki Takimoto; Masaru Noda; Kayo Tsuzaki, all of Shiga, Japan

[73] Assignee: Sanyo Electric Co. Ltd., Osaka, Japan

[21] Appl. No.: 09/031,518

[22] Filed: Feb. 27, 1998

[30] Foreign Application Priority Data

| | | | |
|---|---|---|---|
| Mar. 18, 1997 | [JP] | Japan | 9-064881 |
| Mar. 26, 1997 | [JP] | Japan | 9-073973 |
| Mar. 31, 1997 | [JP] | Japan | 9-081060 |

[51] Int. Cl.[6] ..... H05B 6/68

[52] U.S. Cl. ..... 219/711; 219/705; 219/719; 219/492; 99/325

[58] Field of Search ..... 219/711, 710, 219/754, 703, 705, 708, 719, 492; 99/325

[56] References Cited

U.S. PATENT DOCUMENTS

| | | | |
|---|---|---|---|
| 4,401,884 | 8/1983 | Kusunoki et al. | 219/711 |
| 4,461,940 | 7/1984 | Ishimura | 219/10.55 |
| 4,499,357 | 2/1985 | Kojima | 219/10.55 |
| 4,874,914 | 10/1989 | Eke | 219/710 |
| 5,558,797 | 9/1996 | Takagi | 219/710 |
| 5,780,823 | 7/1998 | Uehashi | 219/710 |

FOREIGN PATENT DOCUMENTS

| | | | |
|---|---|---|---|
| 55-112939 | 9/1980 | Japan | 219/711 |
| 58-110929 | 7/1983 | Japan | 219/711 |
| 2280829 | 2/1995 | United Kingdom . | |

*Primary Examiner*—Philip H. Leung

*Attorney, Agent, or Firm*—Armstrong, Westerman, Hattori, McLeland & Naughton

[57] ABSTRACT

In the operation of a thoroughly heating course of a microwave oven, when an ordinary temperature food having a weight of less than 500 g is heated to a desired finishing temperature of 75° C., heating is performed until the temperature of the food reaches 75° C. by a normal output of 650 W (a first mode). After time $t_1$ at which 75° C. is reached, the food is heated and kept warm at 90° C. higher than 75° C. by a lower output of 350 W (a second mode). As a result, the food can be surely and thoroughly heated to the inside.

9 Claims, 11 Drawing Sheets

COOKING APPARATUS INCLUDING INFRARED RAY SENSOR

BACKGROUND OF THE INVENTION

1. Field of the Invention

The present invention relates generally to cooking apparatuses, and more particularly, to a cooking apparatus for cooking a piece of food placed in the cavity while detecting the temperature of the food using an infrared ray sensor.

2. Description of the Related Art

Some conventional cooking apparatuses, microwave ovens, for example, are provided with an infrared ray sensor. During cooking, the infrared ray sensor senses infrared radiation from a piece of food placed on the turntable rotating in the cavity, and the control unit detects the temperature of the food based on the sensed infrared radiation. The control unit monitors the food to determine if the food has reached an expected finishing temperature.

In such a conventional microwave oven, the control unit automatically controls heating based on the temperature of the food detected in the above-described manner according to a preset automatic heatin course.

The size or thickness of foods to be heated vary. Some food must be heated sufficiently on the inside. In the conventional microwave oven, however, only the temperature of the surface of the food is detected by sensing infrared radiation from the food while heating the same, and the temperature of the inside of the food is not detected. If a large piece of food is heated or if a piece of food should be thoroughly heated to the inside, heating may be over before the inside of the food is heated enough.

SUMMARY OF THE INVENTION

It is an object of the present invention to provide a cooking apparatus capable of surely and sufficiently heating a piece of food to the inside.

The cooking apparatus according to the present invention includes a cavity for accommodating a piece of food, a magnetron for heating the food in the cavity, a turntable for placing the food thereon in the cavity, a turntable motor to drive the turntable, an infrared ray sensor for sensing infrared radiation from the food, and a control unit for detecting the temperature of the food. The control unit drives the magnetron to heat the food to a first temperature in a first mode, and then drives the magnetron to heat the food to a second temperature greater than the first temperature and maintain the food at the second temperature in a second mode.

In the cooking apparatus according to the present invention, the magnetron is driven to heat a piece of food to a first temperature in a first mode and then the magnetron is driven to heat the food to a second temperature higher than the first temperature and to maintain the food at the second temperature in a second mode, so that the food may be heated sufficiently to the inside.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
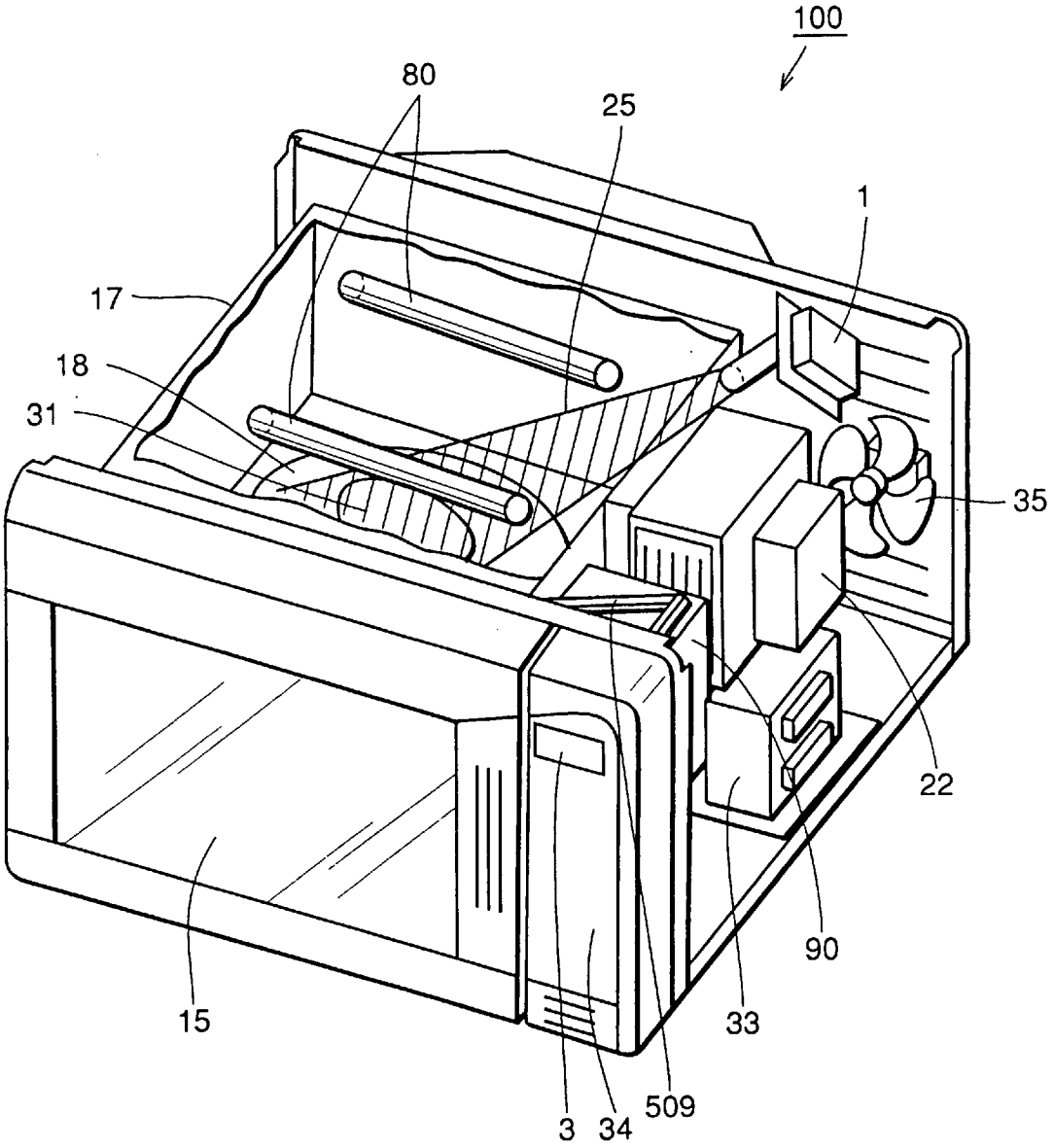
FIG. 1 is a perspective view showing a microwave oven on which each embodiment of the present invention is based.
Figure 2:
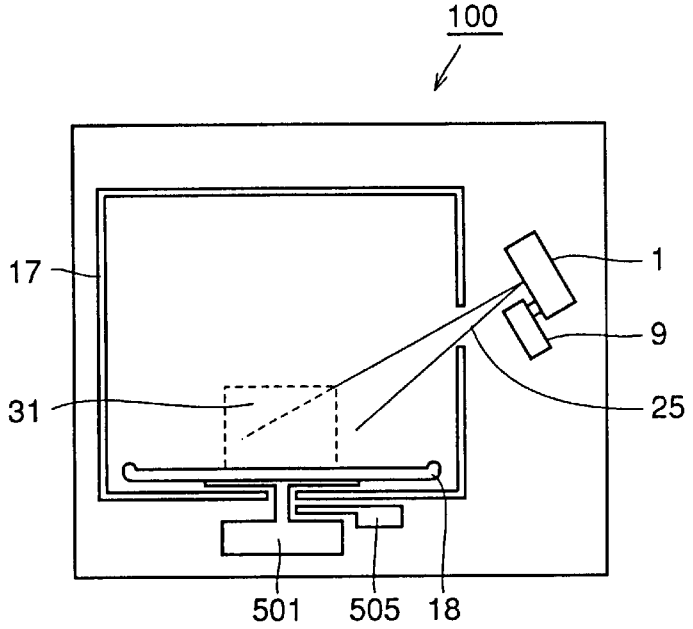
FIG. 2 is a simplified cross-sectional view showing the internal structure of the microwave oven shown in FIG. 1.

Referring to FIGS. 1 and 2, in a microwave oven 100 on which embodiments of the present invention are based, an infrared ray sensor 1 is provided on the upper part of a side of a heating chamber or cavity 17, in other words, at a position to capture infrared rays from a food 31 diagonally from the above. Magnetron 22 supplies microwave energy within cavity 17. A high voltage transformer 33 to supply a high voltage to magnetron 22 is located under magnetron 22. Electric heaters 80 used for oven heating are provided on the upper and lower parts in cavity 17 (the lower heaters are not shown.)

A cooking course is set in response to a key operation in an operation panel 34 including a display portion 3. A cooling fan 35 cools magnetron 22 and its peripheral devices (including infrared ray sensor 1) whose temperatures are raised by the heat in cavity 17. A door panel 15 is attached on the front of cavity 17, and a door detection switch 509 to detect the opening/closing of door panel 15 is provided on the back of operation panel 34. A control unit (microcomputer) 90 which generally controls these devices is also provided on the back of operation panel 34.

A turntable 18 to place a piece of food thereon is rotatably provided on the base of cavity 17. There are provided on the bottom of cavity 17, a turntable motor 505 to rotate turntable 18 and a weight sensor 501 coupled with the rotating shaft of turntable 18 to detect the weight of a food on the turntable. Infrared ray sensor 1 detects a temperature as a chopper motor 9 operates to drive a chopper (not shown) and turn on/off-the incidence of infrared rays.

Figure 3:
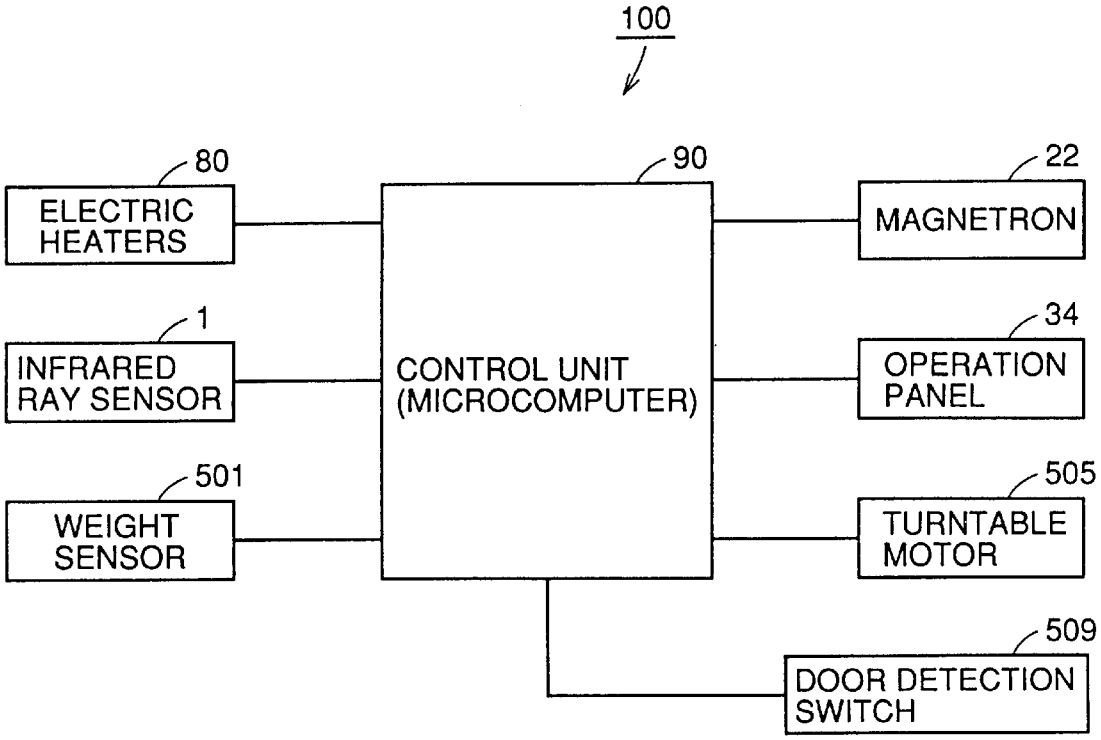
FIG. 3 is a block diagram showing the electrical configuration of the microwave oven shown in FIGS. 1 and 2.

Referring to FIG. 3, the control unit (microcomputer) 90 of the microwave oven is connected with infrared ray sensor 1, magnetron 22, operation panel 34, electric heaters 80, weight sensor 501, turntable motor 505 and door detection switch 509.

Figure 4:
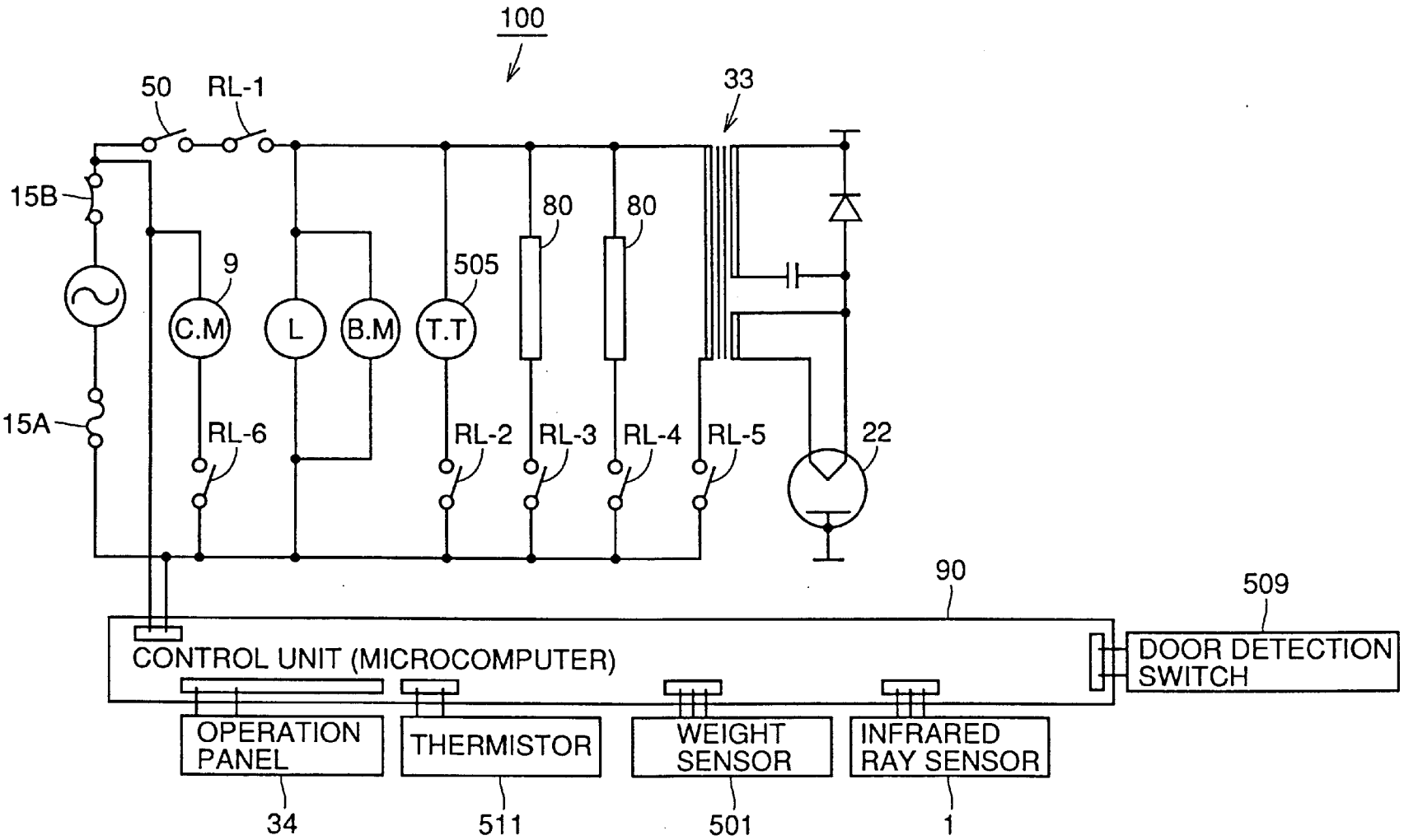
FIG. 4 is a circuit diagram specifically showing the electrical configuration of the microwave oven shown in FIG. 3.

Referring to FIG. 4, the electrical configuration of the microwave oven according to the present invention will be more specifically described. Referring to FIG. 4, one power supply line from a commercial power supply is connected with one end of high voltage transformer 33 on the primary side through a temperature fuse 15B, a door switch 50 which opens/closes in response to the opening/closing of the door panel 15 of cavity 17, and a relay RL-1 which closes in response to a pressing of the heating start button (not shown) of operation panel 34.

The other power supply line from the commercial power supply is connected with the other end of high voltage transformer 33 on the primary side through a 15 ampere fuse 15A, and a relay RL-5 which closes in response to an operation of a switch (not shown) to select microwave heating in operation panel 34. The secondary side of high voltage transformer 33 connected with magnetron 22 supplies a high voltage to magnetron 22.

In the preceding stage of door switch 50 and relay RL-1, the commercial power supply is also connected with control unit 90 including the microcomputer, and control unit 90 is always supplied with a voltage irrespectively of the opening/closing of the door panel and the on/off state of the start button.

Similarly, the commercial power supply is connected with the series-connection of chopper motor 9 of infrared ray sensor 1 and relay RL-6. Therefore, irrespectively of the opening/closing of the door panel and the on/off state of the start button, chopper motor 9 for infrared ray sensor 1 starts to rotate when relay RL-6 is closed, and infrared radiation from food 31 to be heated starts to be detected.

In the succeeding stage of door switch 50 and relay RL-1, there are provided, between the power supply lines, a lamp L for illuminating the inside of cavity 17, a blower motor BM for cooling fan 35 for magnetron 22, the series-connection of turntable motor 505 and relay RL-2, the series-connection of upper heaters 80 and relay RL-3, and the series-connection of lower heaters 80 and relay RL-4, which are connected in parallel with each other.

If therefore door switch 50 and relay RL-1 which operates in association with the start button are closed, lamp L is turned on in cavity 17, and blower motor BM is driven. Closing relay RL-2, RL-3, RL-4 or RL-5 selectively drives turntable motor 505, upper or lower heaters 80 or magnetron 22.

The opening/closing of relays RL-1, RL-2, RL-3, RL-4, RL-5 and RL-6 is controlled by control unit 90 in response to operations of various buttons and switches provided on operation panel 34. Control unit 90 is connected with a thermistor 511 as well as infrared ray sensor 1, weight sensor 501 and door detection switch 509. Note that thermistor 511 is attached on the outer wall of cavity 17 for the purpose of indirectly measuring the temperature in cavity 17.

In microwave oven 100 having the structure, the operation in a "thoroughly heating course" (to thoroughly heat a food to the inside) according to a first embodiment of the present invention will be described in conjunction with FIGS. 5A and 5B.

Figure 5A:
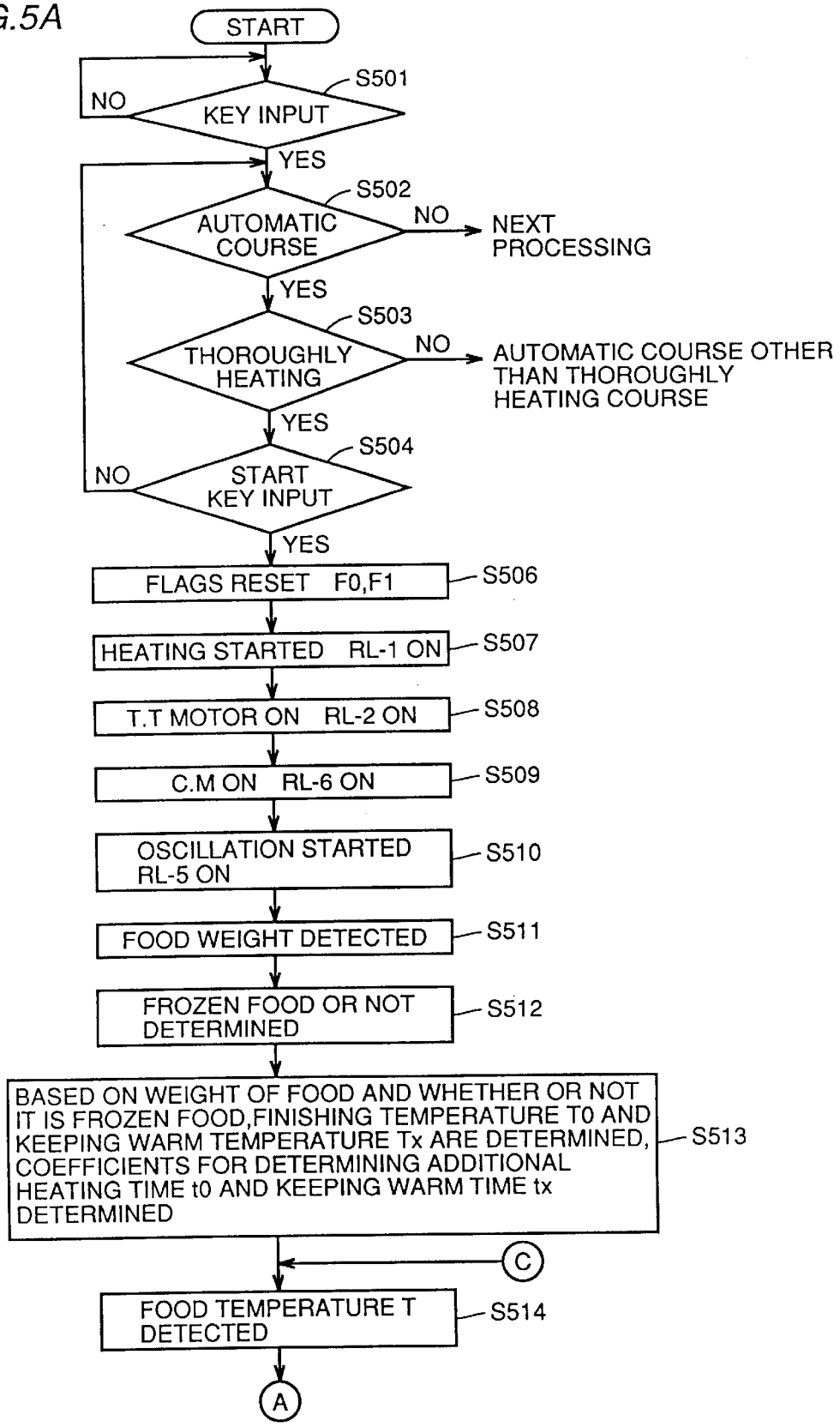
FIGS. 5A and 5B are flow charts for use in illustration of the operation of a microwave oven according to a first embodiment of the present invention.

Referring to FIG. 5A, in step S501 a key input is performed to specify one of various heating courses in operation panel 34. In response to the key input in step S501, it is determined in step S502 if the heating course input in step S501 corresponds to an automatic heating course. If it is determined in step S502 that the input heating course is not an automatic course, the next processing is manually set. If it is determined in step S502 that the input heating course is an automatic course, it is then determined in S503 if the key-input heating course is the "thoroughly heating course" as described above.

If it is determined in step S503 that the "thoroughly heating course" has not been input, an automatic course other than the "thoroughly heating course" is performed. If it is determined in step S503 that the thoroughly heating course has been input, it is then determined in step S504 if the start key to start heating has been depressed. If it is determined in step S504 that the start key has not been depressed, the program returns to step S502 and the above steps of operation are repeated. If it is determined in step S504 that the start key has been depressed, flags F0 and F1 are reset in step S506, the apparatus becomes ready for starting heating. Herein, flag F0 is a determination flag indicating heating by a normal output, and flag F1 is a determination flag indicating heating by using a lower output.

In response to input of the start key, relay RL-1 is turned on in step S507 to start heating. In addition, relay RL-2 is turned on in step S508 to turn on turntable motor 505. Relay RL-6 is turned on in step S509 to turn on chopper motor 9. Relay RL-5 is turned on in step S510 to cause magnetron 22 to start oscillating. Although in this example the food is heated by magnetron 22, according to other heating courses, relay RL-3 and RL-4 are turned on to start heating by electric heaters 80. Alternatively, magnetron 22 and electric heaters 80 are both used in heating.

In step S511, the weight of food 31 placed on turntable 18 is detected by weight sensor 501, and it is determined in step S512 if the heating course determined in step S501 is for a frozen food or an ordinary temperature food. Based on the information obtained in these steps S511 and S512, heating according to the thoroughly heating course according to the invention is controlled.

In the "thoroughly heating course", in addition to the heating course by the normal output, heating for keeping warm by the lower output is performed. In step S513, finishing temperature TO in the normal heating course is set based on the weight of the food and the information related to frozen food or ordinary temperature food obtained in steps S511 and S512. In general, if the weight of the food is greater than a prescribed weight and/or the food is a frozen food, the finishing temperature is set somewhat higher than otherwise, to gradually heat the food through to the inside. Keeping warm temperature Tx for keeping food warm by the lower output following the heating course by the normal output is also set in step S513 based on the information obtained in steps S511 and S512. In general, if the weight of the food is greater than a prescribed weight and/or the food is a frozen food, keeping warm temperature Tx is set somewhat higher than otherwise. Various coefficients for determining additional heating time t0 and keeping warm time tx which will be described are also determined in step S513 based on the information obtained in steps S511 and S512.

Then in step S514, the temperature T of the food is detected by control unit 90 based on the amount of infrared radiation from the food detected by infrared ray sensor 1. Referring to FIG. 5B, it is determined in step S515 if $T \geqq T0$ holds for temperature T. If it is determined in step S515 that $T \geqq T0$ does not holds the program returns to step S514, the food is heated and the temperature is detected until $T \geqq T0$ is established. If $T \geqq T0$ holds in step S515, in other words if the temperature of the food reaches finishing temperature T0, additional heating time t0 is set in step S516. More specifically, if the weight of the food exceeds a prescribed level, even after the temperature T of the food has reached finishing temperature T0, additional heating is performed for additional time t0 corresponding to 0.4 times the time required for the food temperature to reach finishing temperature T0 such that the food is thoroughly heated to the inside. The factor, 0.4 is determined in step S513 based on the information obtained in steps S511 and S512. In step S516, additional heating time t0 is set and counting down of a timer to measure additional heating time t0 is initiated It is then determined in step S517 if the count value t0 of the timer has reached 0. If it is determined in step S517 that the count value t0 of the timer has reached 0, heating for keeping the food warm by the lower output is initiated in step S518. In step S519, the temperature T of the food being heated by the lower output is detected by control unit 90 based on the amount of infrared radiation detected by infrared ray sensor 1. Simultaneously in step S520, keeping warm time tx is determined based on the coefficient set in step S513 and counted down by the timer. It is then determined in step S521 if the count value tx of the timer has reached 0, in other words, if the keeping warm heating time period has expired.

If it is determined in step S521 that the count value tx of the timer has not reached 0, in other words the keeping warm heating time period has not expired, it is then determined in step S522 if the temperature T of the food being heated for keeping warm has reached keeping warm temperature Tx. If it is determined in step S522 that $T \geqq Tx$ is established, the oscillation of magnetron 22 is stopped in step S523 to stop heating of the food. Thus, the temperature of the food can be restricted from excessively increasing. Then, the program returns to step S519, and the temperature T of the food continues to be detected while the keeping warm heating by the lower output has been interrupted until the count value tx of the timer reaches 0, in other words until the keeping warm heating time period expires. If it is determined in step S522 that the temperature T of the food has decreased with time and $T \leqq Tx$ holds, the program returns to step S518 and heating of the food by the lower output is once again initiated.

Then, if the count value tx of the timer reaches 0 in step S521, in other words if the keeping warm heating time period expires, relay RL-5 is turned off in step S524, and the oscillation of magnetron 22 is stopped. Subsequently, relay RL-2 is turned off in step S525, and turntable motor 505 is turned off. Further in step S526, relay RL-6 is turned off, and the chopper motor 9 of infrared ray sensor 1 is stopped. In step S527, relay RL-1 is turned off and the heating operation is completed. Thereafter, microwave oven 100 enters a stand-by state for the next heating operation.

Figure 5B:
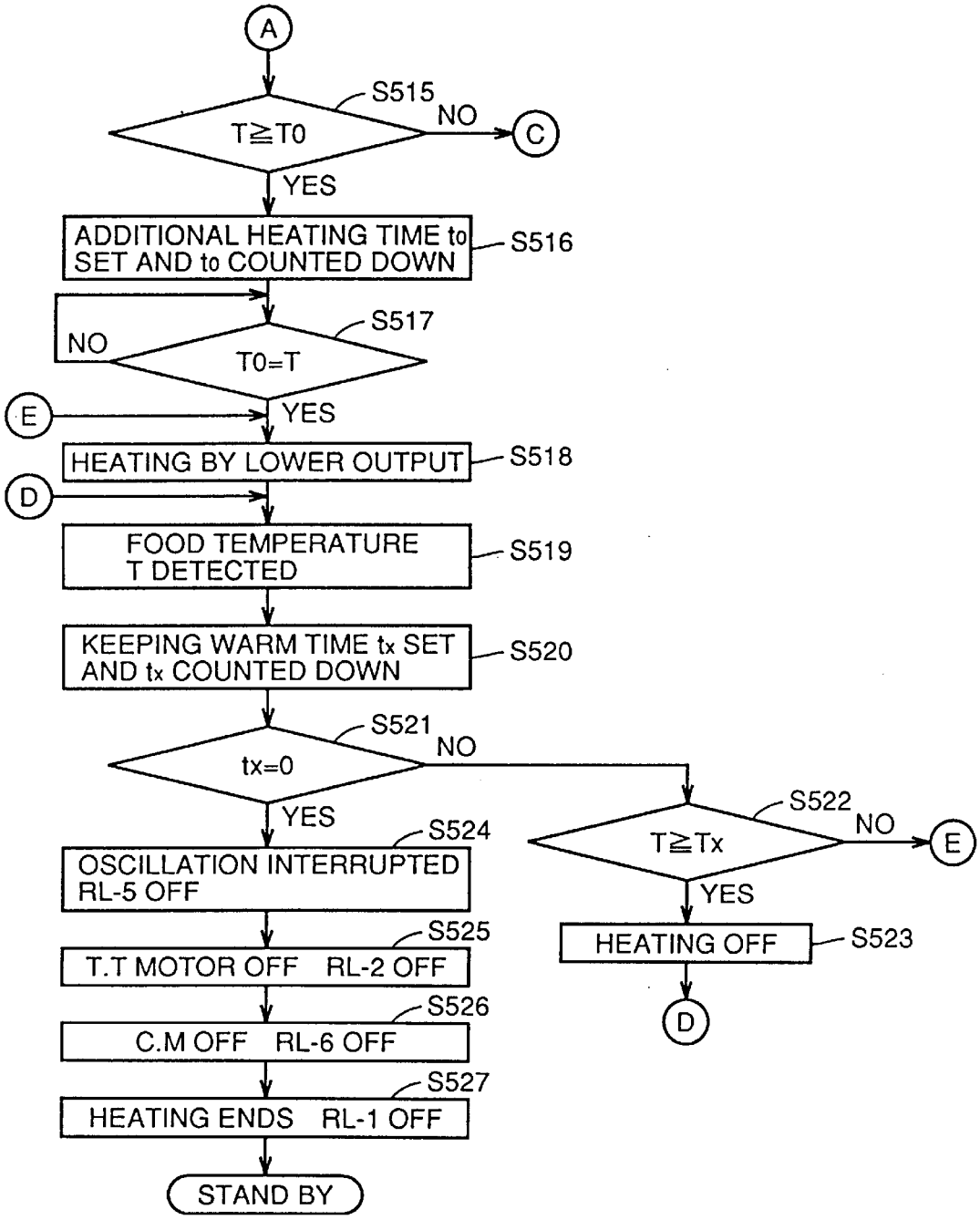
Figure 6A:
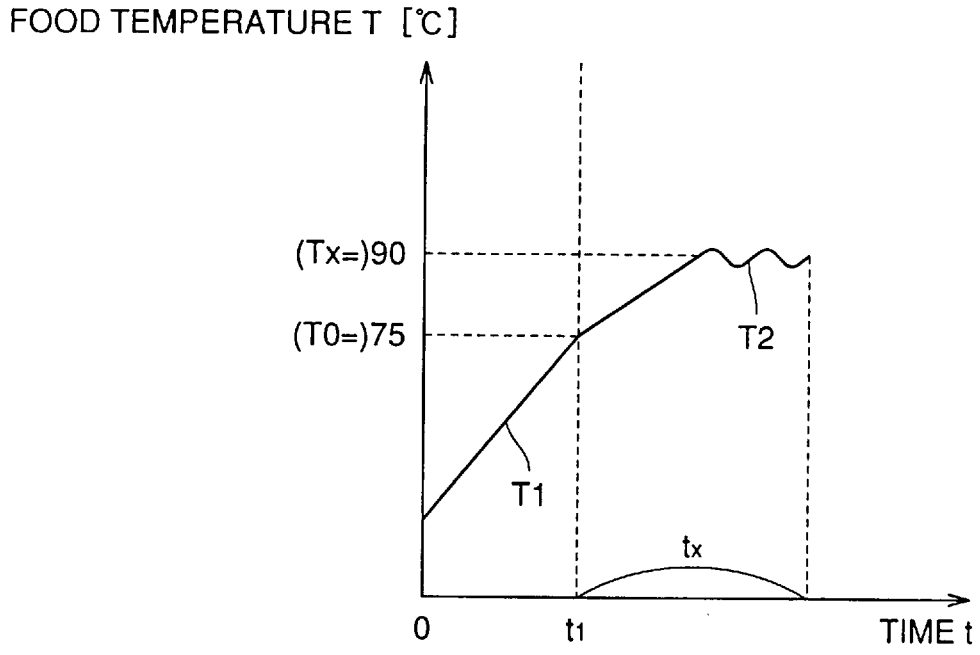
FIGS. 6A and 6B are graphs showing specific examples of the temperature change of an ordinary temperature food heated by the microwave oven of the first embodiment according to the flow charts in FIGS. 5A and 5B.
Figure 6B:
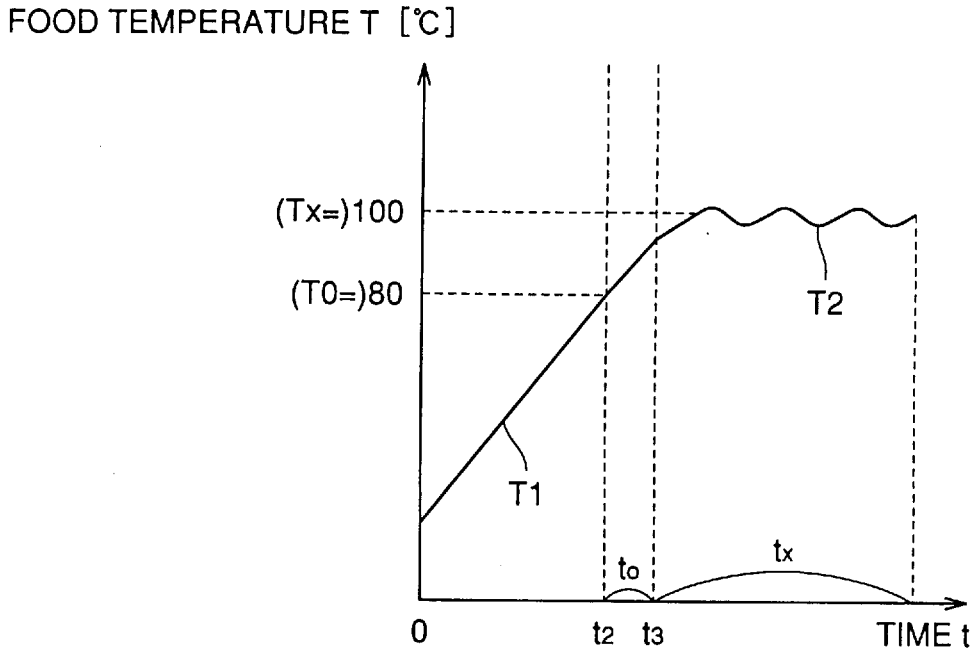

FIGS. 6A and 6B are graphs showing examples of the temperature change of an ordinary temperature food heated by the thoroughly heating course according to the flow charts in FIGS. 5A and 5B. FIG. 6A is a graph of temperature showing the temperature change of an ordinary temperature food having a weight of less than 500 g, and FIG. 6B is a graph showing the temperature change of an ordinary temperature food of not less than 500 g.

Referring to FIG. 6A, when an ordinary temperature food 31 weighing less than 500 g is heated, food 31 is heated until desired finishing temperature T0 of 75° C. by a normal output of 650 W is reached. Heating until time $t_1$ at which the temperature T of food 31 reaches 75° C. is referred to as "first mode", and heating after time $t_1$ is referred to as "second mode". For food weighing less than 500 g, additional heating time t0 is set to 0, and additional heating by the normal output is not performed.

In the second mode after time $t_1$, during keeping warm time period tx based on the coefficient set in step S513, food 31 is heated to be kept warm at a keeping warm temperature Tx of 90° C. which is greater than finishing temperature T0 of 75° C. by a lower output of 350 W. By the keeping warm heating, food 31 may be gradually and thoroughly heated into the inside without burning. Herein, during heating for keeping warm, control unit 90 controls magnetron 22 or heaters 80 to be intermittently turned on/off such that the temperature T of food 31 is maintained around 90° C.

Herein, keeping warm time period tx based on the coefficient set in step S513 is longer for heavier food, and is even longer for a frozen food. In practice, for the heating time period since the start of heating until finishing temperature T0 is reached, larger coefficients are set for heavier foods, and for a frozen food, a time period produced by multiplying an even greater coefficient is set as keeping warm time period tx.

Referring to FIG. 6B, if an ordinary temperature food 31 weighing not less than 500 g is heated, food 31 is heated by the normal output of 650 W until temperature T0 of 80° C. which is somewhat greater than the finishing temperature for the case of the food weighing less than 500 g, as described above is reached. During an additional heating time period to until time $t_3$ ($=1.4t_2$) from time $t_2$ at which the temperature T of food 31 has reached 80° C., heating by the normal output is continued. The heating until time $t_3$ is referred to as "first mode", and heating after time $t_3$ is referred to as "second mode".

In the second mode after time $t_3$, during keeping warm time period tx based on the coefficient set in step S513, food 31 is heated and kept warm at keeping warm temperature Tx of 100° C., which is greater than 80°0 C. and which is the finishing temperature by the lower output of 350 W. By the keeping warm heating, food 31 may be heated gradually and thoroughly to the inside without burning. Furthermore, during the keeping warm heating, control unit 90 controls magnetron 22 or heaters 80 to be intermittently turned on/off such that the temperature T of food 31 is stably maintained around 100° C.

Figure 7A:
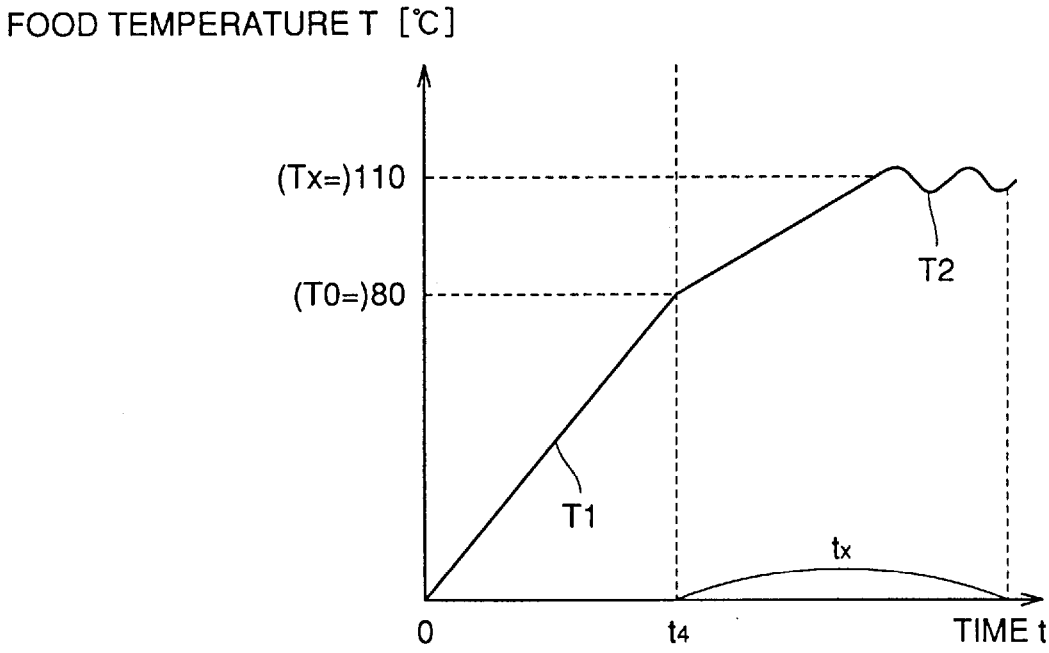
FIGS. 7A and 7B are graphs showing specific examples of the temperature change of a frozen food heated by the microwave oven of the first embodiment according to the flow charts in FIGS. 5A and 5B.
Figure 7B:
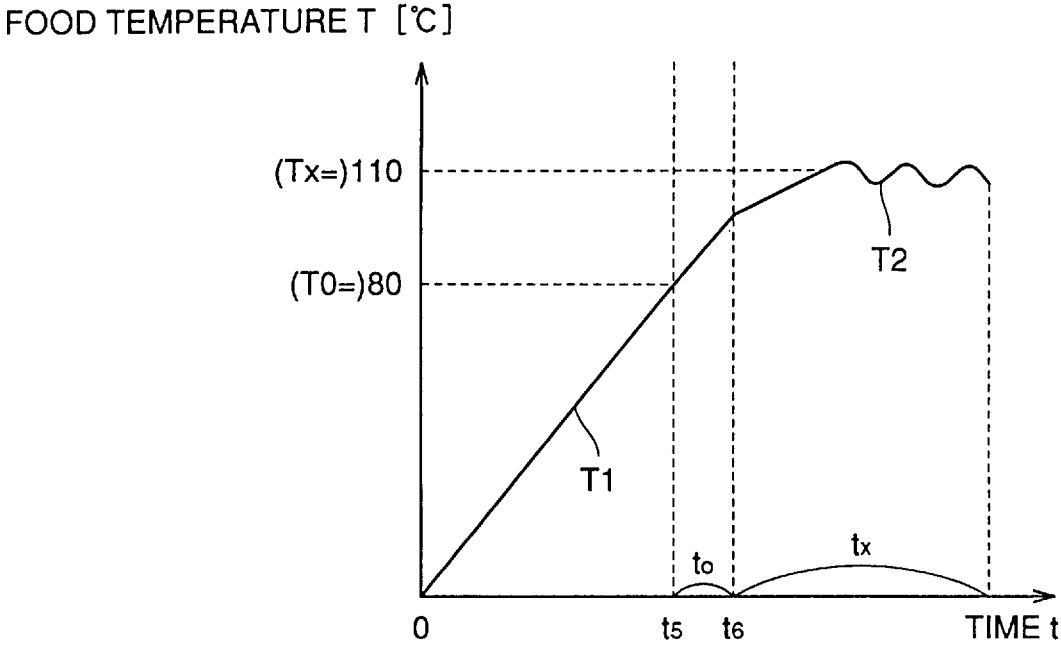

FIGS. 7A and 7B are graphs showing examples of a frozen food heated in the thoroughly heating course according to the flow charts shown in FIGS. 5A and 5B. FIG. 7A is a graph showing the temperature change of a frozen food having a weight of less than 500 g, while FIG. 7B is a graph showing the temperature change of a frozen food having a weight of not less than 500 g. Referring to FIG. 7A, when the frozen food of less than 500 g is heated, since a frozen food is not heated as well as an ordinary temperature food, food 31 is heated until T0=80° C., which is greater than 75° C., the desired finishing temperature of an ordinary temperature, food by the normal output of 650 W. The heating until time $t_4$ at which the temperature T of food 31 reaches 80° C. is referred to as "first mode", and heating after time $t_4$ is referred to as "second mode". For the food weighing less than 500 g, additional heating time period t0 is set to 0, and additional heating by the normal output is not performed.

In the second mode after time $t_4$, during keeping warm time period tx based on the coefficient set in step S513, food 31 is heated and kept warm at keeping warm temperature tx of 110° C. which is greater than finishing temperature T0 of 80° C. by the lower output of 350 W. By the keeping warm heating, food 31 can be gradually and thoroughly heated to the inside without burning. Herein, control unit 90 controls magnetron 22 or heaters 80 to be intermittently turned on/off such that the temperature T of food 31 is stably maintained at about 110° C.

Now referring to FIG. 7B, frozen food 31 weighing not less than 500 g is heated by the normal output of 650 W until finishing temperature T0 of 80° C. is reached. During additional heating time period t0 since time $t_5$ at which the temperature T of food 31 reaches 80° C. to time $t_6$ (=1.4 $t_5$), the heating by the normal output continues. The heating until time $t_6$ is referred to as "first mode", while the heating after time $t_6$ is referred to as "second mode".

In the second mode after time $t_6$, during keeping warm time period tx based on the coefficient set in step S513, food 31 is heated and kept warm at keeping warm temperature Tx of 110° C., which is greater than 80° C. by the lower output of 350 W. By the keeping warm heating, the food can be gradually and thoroughly heated to the inside without burning. During the keeping warm heating, control unit 90 controls magnetron 22 or heaters 80 to be intermittently turned on/off such that the temperature T of food 31 is stably maintained at around 110° C.

As described above, according to the first embodiment of the invention, if a food to be heated has a large volume or a large thickness, or a food is to be sufficiently heated to the inside, the food can be thoroughly heated to the inside without burning the surface of the food.

Heating can be completed in a shorter time period if a control is made such that heating is rapidly performed at a temperature greater than the finishing temperature in the first mode and the finishing temperature is adjusted in the following keeping warm heating in the second mode.

As described above, by heating in the thoroughly heating course by the microwave oven according to the first embodiment, a food can be automatically heated in an optimum heating course, and the food can be heated thoroughly to the inside.

Figure 8:
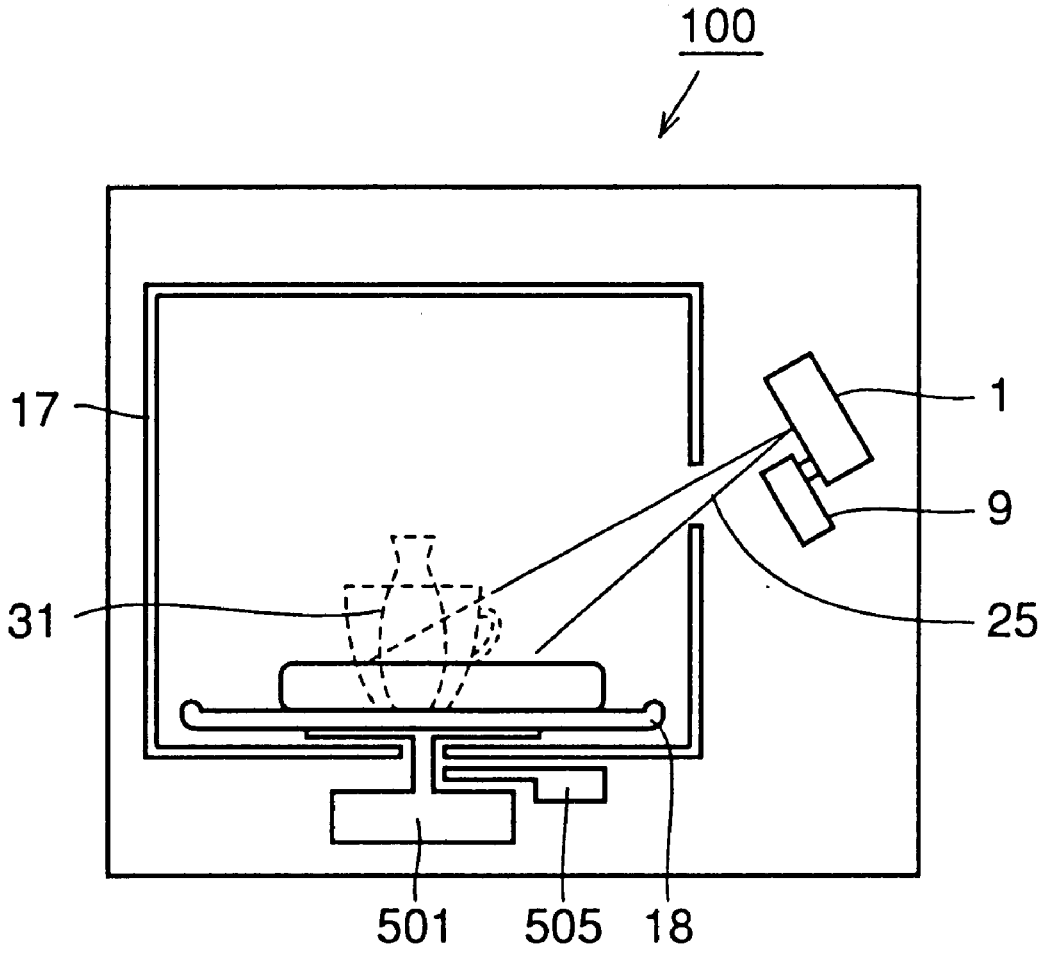
FIG. 8 is a cross sectional view of a microwave oven for use in schematic illustration of the function of the microwave oven according to a second embodiment of the present invention.

In the microwave oven having infrared ray sensor 1 located at the upper part of a side at a position to capture infrared rays 25 from food 31 diagonally from the above as shown in FIG. 1, infrared radiation from a number of cups filled with milk or Tokkuri (Japanese sake bottles) filled with sake placed on the turntable and detected by the infrared ray sensor is liable to be unequal. If a sake bottle having a curved shape and a certain height as shown in FIG. 8 is placed on the turntable, detected infrared rays largely differ between the narrow portion and the large portion with sake inside, which results in significant detection errors.

In a microwave oven having an infrared ray sensor provided in the center of the upper part of the cavity, if food items are not evenly placed on the turntable, detection errors result.

Furthermore, a plurality of objects are more difficult to heat and prone to more heating variation than heating a single object. For example, between heating a single bottle of sake and heating a plurality of bottles of sake, the manner in which the objects to be heated receive microwave energy from the magnetron varies with time, and heating a plurality of bottles of sake results more heating variation than heating a single bottle, in other words a plurality of objects are less easily warmed.

Therefore, if a certain finishing temperature T0 is set according to the first embodiment, the relation between the field of the infrared ray sensor and the position of foods to be heated varies depending upon the number or amount of foods, and there may be errors in detected temperatures. Furthermore, since the relation between the magnetron and the position of foods to be heated varies depending upon the number or amount of foods, heating variations may be caused. Such detection errors or heating variations could change the finishing temperature in practice depending upon the number or amount of foods. A second embodiment of the present invention is directed to a solution to such a possibility, and according to the embodiment, a fixed finishing temperature T0 may be achieved irrespectively of the number of pieces or amount of food to be heated.

Figure 9:
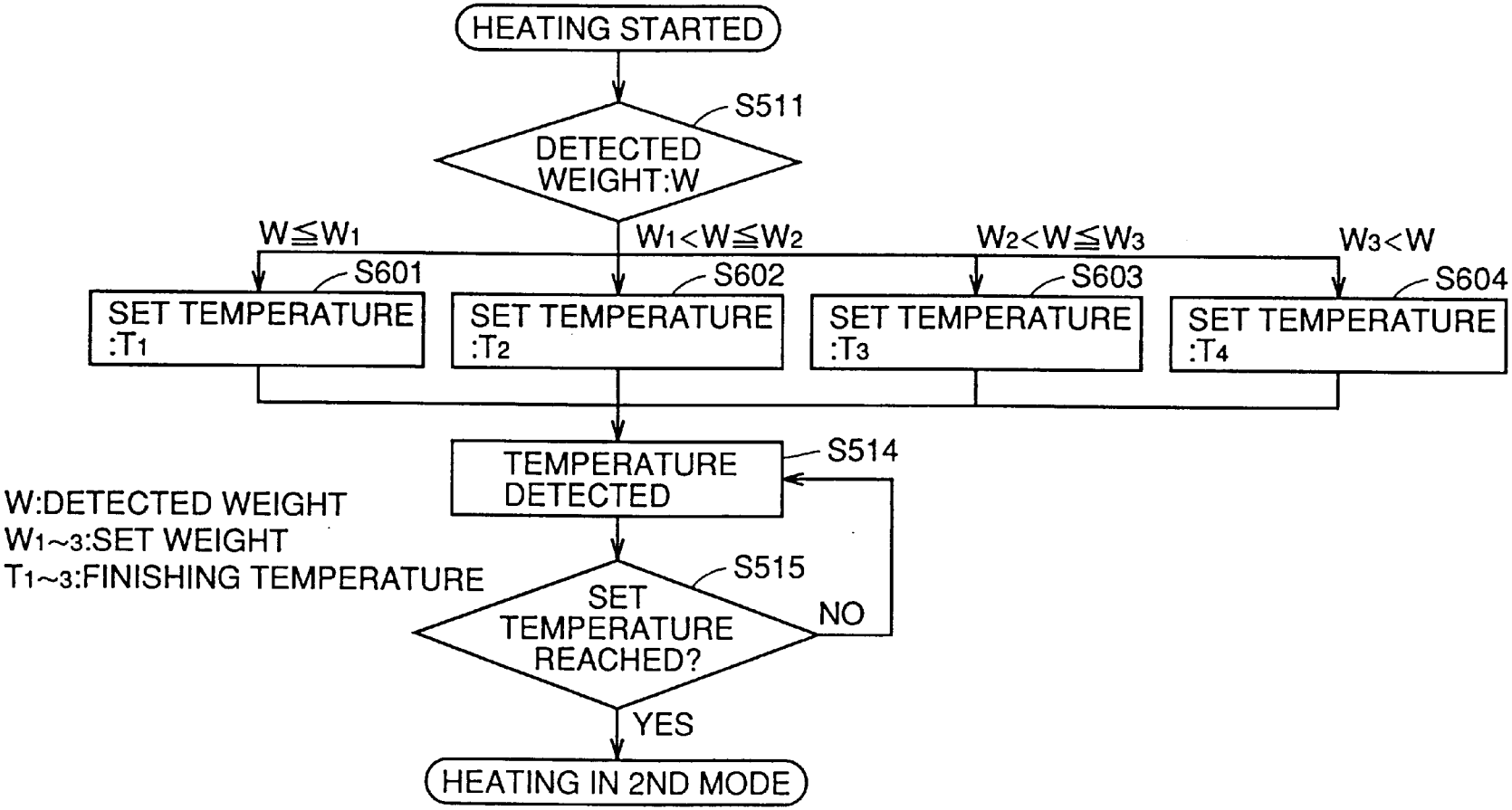
FIG. 9 is a flow chart for use in illustration of the operation of the microwave oven according to the second embodiment.

The operation in a thoroughly heating course according to the second embodiment is basically the same as the operation of the thoroughly heating course according to the first embodiment shown in FIGS. 5A and 5B. The second embodiment is different from the first embodiment in the method of setting the finishing temperature TO or the keeping warm temperature Tx in step S513 in FIG. 5A. Referring to FIG. 9, a method of setting finishing temperature T0 in the thoroughly heating course according to the second embodiment will be now described. In step S511 in FIG. 5A, the weight W of food 31 is detected by weight sensor 501. Control unit 90 accordingly compares the weight W of food 31 detected by weight sensor 501 and prescribed weights $W_1$, $W_2$, and $W_3$ ($W_1<W_2<W_3$) pre-stored in control unit 90.

If the detected weight W of food 31 in step S511 satisfies $W \leqq W_1$ in step S601 control unit 90 sets finishing temperature T0 to a set temperature $T_1$ pre-stored in control unit 90 corresponding to a weight not more than prescribed weight $W_1$, and controls magnetron 22 or heaters 80 to heat food 31 until the detected temperature T of food 31 reaches set temperature $T_1$.

If detected weight W satisfies $W_1<W \leqq W_2$, in step S 602, control unit 90 sets finishing temperature T0 to a set temperature $T_2$ ($T_1 \leqq T_2$) pre-stored in control unit 90 corresponding to a weight not more than prescribed weight $W_2$, and controls magnetron 22 or heaters 80 to heat food 31 until the detected temperature T of food 31 reaches set temperature $T_2$.

If detected weight W satisfies $W_2<W \leqq W_3$, in step S603, control unit 90 sets finishing temperature T0 to a set temperature $T_3$ ($T_2 \leqq T_3$) pre-stored in control unit 90 corresponding to a weight not more than prescribed weight $W_3$, and controls magnetron 22 or heaters 80 to heat food 31 until the detected temperature T of food 31 reaches set temperature $T_3$.

If detected weight W satisfies $W_3<W$, in step S604, control unit 90 sets finishing temperature T0 to set temperature T4 ($T_3 \leqq T_4$) pre-stored in control unit 90 corresponding to a weight greater than prescribed weight $W_3$, and controls magnetron 22 or heaters 80 to heat food 31 until the detected temperature T of food 31 reaches set temperature $T_4$.

As described above, the greater the weight of food 31 is, the higher the finishing temperature is set, and for a longer time period, control unit 90 continues to heat food 31.

In step S514 in FIG. 5A, control unit 90 detects the temperature T of a food, and it is determined in step S515 in FIG. 5B if the temperature detected in step S514 has reached the set temperature. If it is determined in step S515 that the detected temperature has reached the finishing temperature, control unit 90 completes the heating in the first mode, and transits to heating in the second mode. If it is determined in step S515 that the detected temperature has not reached the set temperature, steps S514 and S515 are repeated until the temperature of food 31 reaches the set temperature.

For sake or milk, control unit 90 stores optimum heating temperatures depending upon the number of bottles or cups as set temperatures, the number of bottles or cups is predicted based on weight w detected by weight sensor 501, and heating is conducted at a temperature set corresponding to the number of bottles or cups.

More specifically, in a heating course to warm Tokkuri (bottles) of sake, weight $W_1$ for example corresponds to the weight of a single bottle of sake, weight $W_2$ corresponds to the weight of two bottles of sake, and weight $W_3$ corresponds to the weight of three bottles of sake. As another example, in a heating course to warm cups of milk, weight $W_1$ corresponds to the weight of a single cup of milk, weight $W_2$ corresponds to the weight of two cups of milk, and weight $W_3$ corresponds to the weight of three cups of milk.

Table 1 shows examples of automatic menus according to the second embodiment and measured temperature values when heating is conducted in these automatic menus.

TABLE 1

(Unit: ° C.)

| Menu | No. | Variable Set Temperature | Fixed Set Temperature |
|---|---|---|---|
| Sake | 1 | 55.0 | 56.1 |
| | | Set temp. : 45 | Set temp.: 45 |
| | 2 | 51.5/55.8 | 44.9/47.4 |
| | | Set temp.: 60 Ave. 53.7 | Set temp.: 45 Ave. 46.2 |
| | 3 | 53.0/55.3/56.3 | 37.6/38.0/38.0 |
| | | Set temp.: 70 Ave 54.9 | Set. temp.: 45 Ave. 37.9 |
| | 4 | 53.4/53.5/52.5/51.4 | 37.0/35.8/36.8/36.2 |
| | | Set temp.: 75 Ave. 52.7 | Set temp.: 45 Ave. 36.5 |
| Milk | 1 | 56.4 | 63.0 |
| | | Set temp.: 46 | Set temp.: 50 |
| | 2 | 55.2/57.2 | 43.2/43.2 |
| | | Set temp.: 66 Ave. 56.2 | Set temp.: 50 Ave. 43.2 |
| | 3 | 55.2/55.8/57.1 | 37.8/39.1/37.3 |
| | | Set temp.: 75 Ave. 56.0 | Set temp.: 50 Ave. 38.1 |
| | 4 | 53.2/57.5/55.8/57.5 | 30.8/31.8/30.7/30.7 |
| | | Set temp.: 80 Ave. 56.0 | Set temp.: 50 Ave. 31.0 |

Ave.: Average temperature

Referring to Table 1, two kinds of automatic menus, "warming sake" and "warming milk" are shown by way of illustration. For each automatic menu, there are given set temperatures corresponding to pre-set weights in the control unit 90 of microwave oven 100, actual finishing temperatures for sake or milk when heated at the set temperatures, and actual finishing temperatures when heating is performed by a conventional microwave oven by which the set temperature is not changed depending upon the weight.

The case of "warming sake" will be now described.

Referring to Table 1, when weight sensor 501 in microwave oven 100 detects the weight of a bottle of sake (not more than 592 g in this example), heating is performed until the temperature detected by control unit 90 reaches the corresponding set temperature of 45° C. When the weight of two bottles of sake is detected, heating is performed until the temperature detected by control unit 90 reaches the corresponding set temperature of 60° C. When the weight of three bottles of sake is detected, heating is performed until the temperature detected by control unit 90 reaches the corresponding set temperature of 70° C. When the weight of four bottles of sake is detected, heating is conducted until the temperature detected by control unit 90 reaches the corresponding set temperature of 75° C.

The temperature of sake measured after being stirred is 55° C. for a single bottle, 53° C. on the average for two bottles, 54.9° C. on the average for three bottles, and 52.7° C. on the average for four bottles.

Meanwhile, using the conventional microwave oven, the set temperature is always 45° C. irrespective of the weight, the measured temperature is 56.1° C. for a single bottle, 46.2° C. on the average for two bottles, 37.9° C. on the average for three bottles, and 36.5° C. on the average for four bottles.

Therefore, if heating is conducted using the conventional microwave oven, since the set temperature is fixed even if the weight (or the number of bottles) increases, the finished temperature tends to decrease as the weight (or the number of bottles) increases. By microwave oven 100 according to the second embodiment, if the weight (or the number of bottles) increases, heating is automatically performed at a corresponding higher set temperature accordingly, the finished temperature changes little depending upon the weight. In other words, sake can be always warmed to an optimum temperature irrespective of the number of bottles.

"Warming milk" will be now described.

Referring to Table 1, when the weight sensor 501 of microwave oven 100 detects the weight of a single cup of milk (not more than about 640 g in this example), heating is conducted until the temperature detected by control unit 90 reaches the corresponding set temperature of 46° C. When the weight of two cups of milk is detected, heating is conducted until the temperature detected by control unit 90 reaches the corresponding set temperature of 66° C. When the weight of three cups of milk is detected, heating is conducted until the temperature detected by control unit 90 reaches the corresponding set temperature of 75° C. When the weight of four cups of milk is detected, heating is conducted until the temperature detected by control unit 90 reaches the corresponding set temperature of 80° C.

After the heating, the temperature of milk after stirred is 56.4° C. for a single cup, and the average measured temperature is 56.2° C. for two cups, 56.0° C. for three cups, and 56° C. for four cups.

Meanwhile, by the conventional microwave oven, the set temperature is always 50° C. irrespective of the weight, the measured temperature for a single cup is 63.0° C., and the average measured temperature is 43.2° C. for two cups, 38.1° C. for three cups, and 310° C. for four cups.

Therefore, using the conventional microwave oven, the set temperature is fixed even if the weight (or the number of cups) increases, the actual finished temperature tends to be lowered as the weight (or the number of cups) increases. Using microwave oven 100 according to the second embodiment, if the weight (or the number of cups) increases, heating is performed at a higher set temperature accordingly, the actual finished temperature changes little depending upon the weight. In other words, milk can be always warmed to an optimum temperature regardless of the number of cups.

During setting a heating course and during heating, the desired finishing temperature is displayed rather than the set temperature corresponding to the weight or number at display portion 3 on operation panel 34, and therefore the user can make an accurate estimate of the actual temperature as finished rather than mistaking the desired finishing temperature.

As in the foregoing, in the thoroughly heating course by microwave oven 100 according to the second embodiment, irrespective of the weight or number of items of food 31 to be heated, the items of food can be always warmed up to a fixed optimum temperature. Since the display portion gives the desired finishing temperature, the user does not misunderstand the desired finishing temperature and can accurately estimate the actual finishing temperature.

In the above embodiments, a food is not necessarily placed within the field of infrared ray sensor 1, and if a number of items of food are placed unevenly on the turntable, the items of food come in and out of the field of infrared rays as the turntable rotates In such a case, the temperature of the turntable is erroneously as the temperature of the items of food, and therefore the accurate temperature of the items of food may not be detected.

In particular, if the infrared ray sensor is positioned in the upper part of a side of the cavity to detect items of food diagonally frozen the above, foods placed unevenly on the turntable are often out of the field of the infrared ray sensor. Even in a microwave oven having an infrared ray sensor placed in the upper part of the cavity, the accurate temperature of foods unevenly placed on the turntable may not be detected either.

A third embodiment of present invention is directed to an improvement to solve such a problem, and permits more accurate detection of the temperature of a food being heated.

Figure 10A:
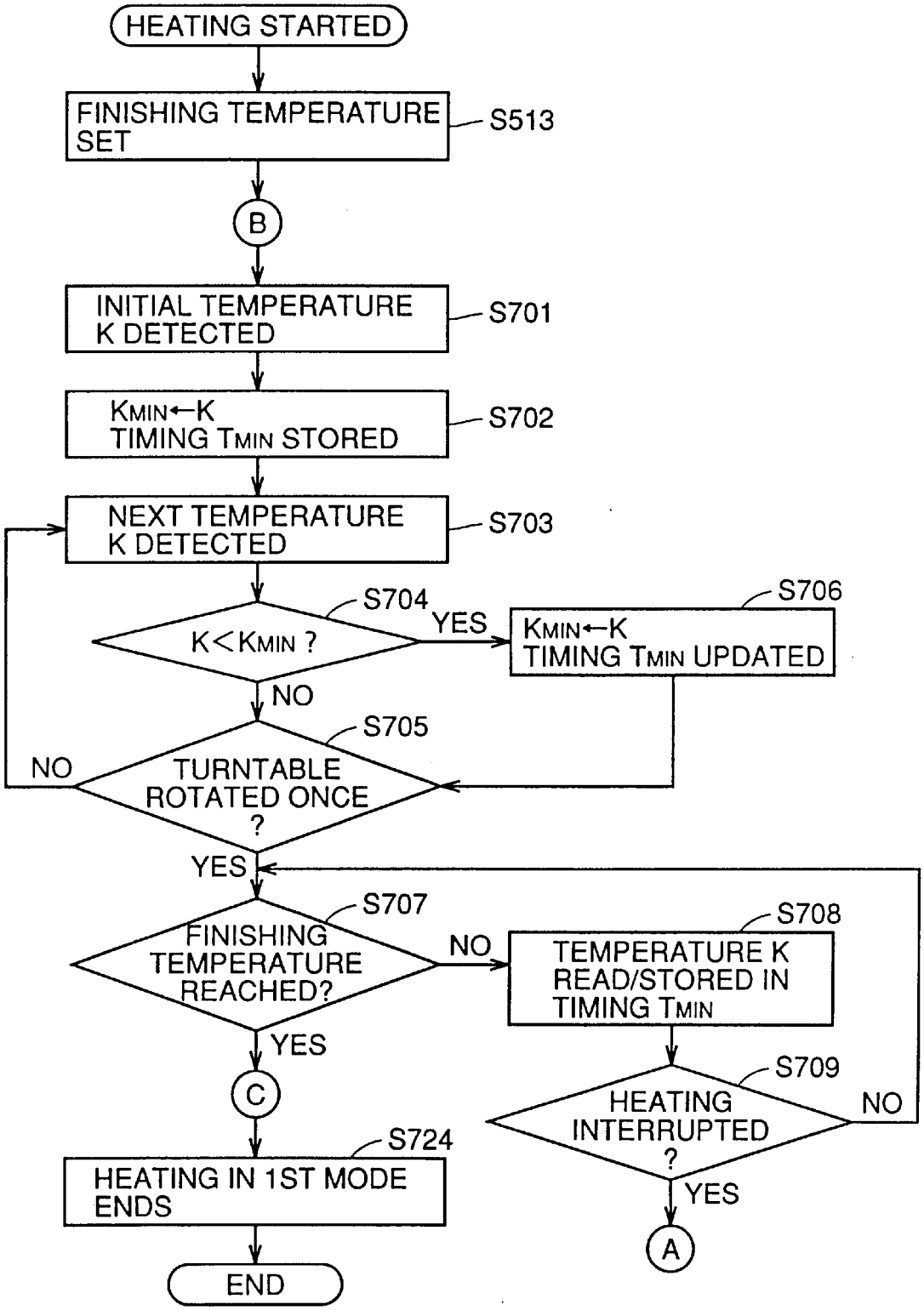
FIGS. 10A and 10B are flow charts for use in illustration of the operation of a microwave oven according to a third embodiment of the present invention.
Figure 10B:
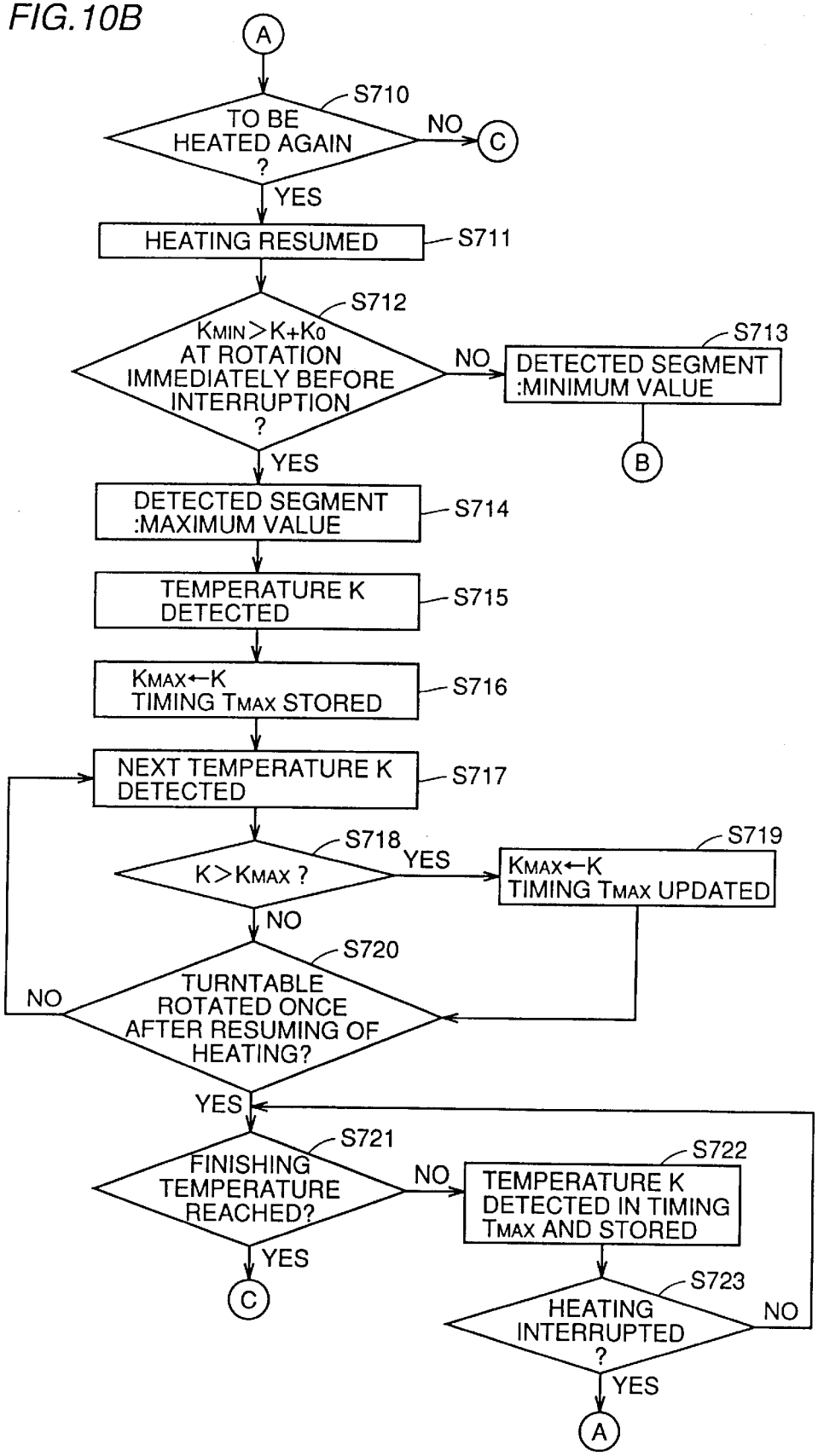

The operation in the thoroughly heating course of a microwave oven according to the third embodiment is basically the same as the operation of the first embodiment shown in FIGS. 5A and 5B, and the only difference lies in the method of detecting food temperature T in FIGS. 5A and 5B. Referring to FIGS. 10A and 10B, the operation in the thoroughly heating course according to the third embodiment will be now described.

When control unit 90 starts heating in response to a key input in operation panel 34, a finishing temperature is set in step S513 in FIG. 5A. The operation according to the third embodiment which will be described corresponds to steps S514 and S515 according to the first embodiment shown in FIGS. 5A and 5B.

When heating is started and the finishing temperature is set in S513, control unit 90 continuously detects the temperature of food 31 at the first rotation of turntable 18. The temperature detection is based on infrared rays radiated from food 31 and detected by infrared ray sensor 1.

In step S701, the temperature of food 31 is detected for the first time at the first rotation of turntable 18, and detected temperature K is stored in the internal memory (not shown) of control unit 90.

Herein, if a food which has been stored in a refrigerator for example is to be warmed, the food placed on the ordinary temperature turntable 18 has a temperature lower than the temperature of turntable 18, the position of the food may be specified according to the control of this embodiment, and the temperature of the food can be accurately detected. The temperature of food to warm is usually less than the temperature of turntable 18, and a method of control corresponding to the case is shown in FIGS. 10A and 10B.

In step S702, control unit 90 controls the internal memory to store temperature K detected in S701 as minimum value $K_{MIN}$, together with the timing $T_{MIN}$ in which minimum value $K_{MIN}$ was detected. In step S703, control unit 90 performs the next temperature detection at the first rotation of the turntable 18, and stores the obtained detected temperature K of food 31 in the internal memory. In step S704, control unit 90 compares the detected temperature K of food 31 read in S703 and the minimum value $K_{MIN}$ of the detected temperature stored in the internal memory, and it is determined if $K<K_{MIN}$ holds. If $K<K_{MIN}$ is not true in step S704, in step S705 control unit 90 determines if turntable 18 has made one rotation. If $K<K_{MIN}$ is true in step S704, in step S706 control unit 90 controls the internal memory to store detected temperature K in step S703 as minimum value $K_{MIN}$ together with the timing $T_{MIN}$ in which minimum value $K_{MIN}$ was detected, and the program proceeds to step S705.

If it is determined in step S705 that turntable 18 has not made one rotation, the program returns to S703, and the temperature continues to be detected, and the minimum value $K_{MIN}$ of the detected temperature of food 31 during one rotation of turntable 18 is produced. If it is determined in step S705 that turntable 18 has made one rotation, in step S707 control unit 90 determines if detected temperature K has reached the desired finishing temperature of food 31. If it is determined in step S707 that the temperature of food 31 has reached the finishing temperature, the heating in the first mode is completed. If it is determined in step S707 that the temperature of food 31 has not reached the finishing temperature, in step S708, control unit 90 validates temperature K detected in timing $T_{MIN}$ in the second and subsequent rotations, and controls the internal memory to store the temperature as the detected temperature of food 31. The operation of temperature detection and reading/storing is repeated until the temperature of food 31 reaches the finishing, temperature. If a piece of food whose temperature is greater than turntable 18 is warmed, the maximum value $K_{MAX}$ of the detected temperature and the timing in which maximum value $K_{MAX}$ is detected are stored in the internal memory in place of the above minimum value $K_{MIN}$ of the detected temperature.

During repeating the temperature detection and storing in step S708 until the temperature of food 31 reaches the finishing temperature, if the power supply is interrupted or door panel 15 is opened as heating goes on, the heating may be interrupted as a result. Upon the interruption, the levels of the temperatures of food 31 turntable 18 may be reversed by heating up to that point and the temperature of food 31 may be higher than the temperature of turntable 18. Furthermore, when heating is resumed, the direction of rotation of turntable 18 may be reversed from the direction of rotation before the interruption. Therefore, after resuming the heating, control unit 90 must make controls corresponding to various cases. Control in such a case is represented by subroutine A in FIG. 10A, and the flow chart thereof is given in FIG. 10B.

It is determined in step S709 in FIG. 10A if heating has been interrupted. If, for example, door panel 15 is opened during heating, door detection switch 509 detects the opening of the door panel and sends the detection signal to control unit 90. Control unit 90 controls magnetron 22 or heaters 80 to stop heating based on the detection signal from door detection switch 509. If it is determined in step S709 that heating has not been interrupted, the control from S707 to S709 is repeatedly performed until temperature K stored in timing $T_{MIN}$ reaches the desired finishing temperature.

If it is determined in step S709 in FIG. 10A that heating has been interrupted, the control of subroutine A shown in FIG. 10B is conducted. Referring to FIG. 10B, it is determined in step S710 if re-heating is to be performed. If it is determined in step S710 that re-heating is not to be performed, the program proceeds to C in FIG. 10A, and control unit 90 completes heating in the first mode in step S724.

If it is determined in step S710 that re-heating is to be performed, in step S711 control unit 90 resumes heating by the oscillation of magnetron 22 or oven heating by heaters 80. When heating is resumed in step S711, based on stored temperature K detected at a rotation immediately before the interruption of the heating, it is determined in step S712 if temperature $K_{MIN}$ detected in timing $T_{MIN}$ satisfies $K_{MIN}>K+K0$ ($K_0$: a constant or function). If it is determined in step S712 that $K_{MIN}>K+K0$ holds, the detected segment is set as a maximum value in step S714. More specifically, at the interruption of heating, the temperature of food 31 has been raised to a temperature higher than turntable 18, and the position of food 31 on turntable 18 is available by detecting timing $T_{MIX}$ in which the detected temperature attains a maximum value during one rotation of turntable 18. Meanwhile, if it is determined in step S712 that $K_{MIN}>K+K_0$ does not hold, the detected segment is set as a minimum value. More specifically, at the interruption of heating, the temperature of food 31 does not exceed the temperature of turntable 18, the program proceeds to B in FIG. 10A, and the control in and before step S701 is performed.

If the detected segment is set as a maximum value in step S714, at the first rotation of turntable 18 after the re-start of heating, the temperature K of food 31 detected in the first timing in step S715 is stored in the internal memory, temperature K read in step S715 is stored as a virtual maximum value together with the timing in which temperature K was detected as $T_{MAX}$. Then, in step S717 the temperature was detected in the next timing during the same rotation, and newly detected temperature K is stored in the internal memory. Temperature K read in S717 is compared in step S718 with maximum value $K_{MAX}$ stored in step S716, and if $K>K_{MAX}$, in step S719, maximum value $K_{MAX}$ is updated to temperature K read in step S717. At the time, $T_{MAX}$ is also updated to the timing in which temperature K read in step S717 was detected.

It is then determined in step S720 if turntable 18 has made one rotation after the re-start of heating. If $K>K_{MAX}$ does not hold in step S718, maximum value $K_{MAX}$ and timing $T_{MAX}$ are not updated, and it is determined in step S720 if turntable 18 has made one rotation. Thus, by detecting timing $T_{MAX}$ in which the detected temperature attains a maximum value during one rotation of turntable 18, the position of food 31 on turntable 18 is available.

If it is determined in step S720 that turntable 18 has not yet made one rotation, the program returns to step S717 and temperature K is again detected. More specifically, the control in steps S717 to S720 is repeated until turntable 18 rotates once after the restart of heating If it is determined in step S720 that turntable 18 has made one rotation, it is then determined in step S721 if maximum value $K_{MAX}$ has reached the desired finishing temperature If it is determined in step S721 that the finishing temperature has not been reached, in step S722 temperature K is detected and stored iii timing $T_{MAX}$ in step S722.

If it is determined in step S723 that heating is once again interrupted, the program returns to subroutine A and the control in and after step S710 is repeatedly performed. If it is determined in step S723 that heating has not been interrupted, the temperature is detected in timing $T_{MIN}$ every time turntable 18 makes one rotation, and the control in steps S721 to S723 is repeated until detected temperature K reaches the finishing temperature. If it is determined in step S721 that temperature K has reached the finishing temperature, the program proceeds to C in FIG. 10A, and heating in the first mode is completed in step S721.

Therefore, by storing the minimum value $K_{MIN}$ (or maximum value $K_{MAX}$) of the detected temperature during one rotation of turntable 18, together with timing $T_{MIN}$ (or $T_{MAX}$) in which minimum value $K_{MIN}$ (or maximum value $K_{MAX}$) is detected, the position of food on turntable 18 can be specified, and the temperature of the food can be accurately detected. Furthermore, if the power supply is cut off or door panel 15 is opened to interrupt heating, the position of the food is again accurately specified and therefore the temperature of the food can be detected.

In the thoroughly heating course by the microwave oven according to the third embodiment of the present invention, the position of the food can be accurately specified, and the temperature of the food can be detected.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cooking apparatus, comprising:

a heating chamber for accommodating a food;

heating means for heating said food in said heating chamber;

a turntable for placing said food thereon within said heating chamber;

a turntable motor for driving said turntable;

an infrared ray sensor for detecting infrared rays radiated from said food; and a control unit for detecting the temperature of said food based on said infrared rays detected by said infrared ray sensor, said control unit driving said heating means at a first power setting until said food reaches a first temperature in a first mode, and then driving said heating means at a second power setting less than said first power setting to heat said food to a second temperature greater than said first temperature and to keep the food at said second temperature in a second mode.

2. The cooking apparatus as recited in claim 1, wherein said first temperature is a desired finishing temperature for said food, and said second temperature is a temperature greater than said desired finishing temperature for said food.

3. The cooking apparatus as recited in claim 1 further comprising a weight sensor for detecting the weight of said food, wherein heating time in said first mode increases as the weight of said food detected by said weight sensor increases.

4. The cooking apparatus as recited in claim 1, further comprising means for determining if said food is an ordinary temperature food or a frozen foods wherein heating time in said first mode is greater for a frozen food than for an ordinary temperature food.

5. The cooking apparatus as recited in claim 1, wherein said control unit stores a timing in which a maximum or minimum temperature among temperatures detected during one rotation of said turntable is detected after heating by said heating means is started, and performs temperature detection in said stored timing at a second rotation and on.

6. The cooking apparatus as recited in claim 5, wherein if heating by said heating means is interrupted and then resumed, said control unit stores a timing in which a maximum or minimum temperature among temperatures detected during one rotation of said turntable is detected after heating by said heating means is resumed, and performs temperature detection in said timing at a second rotation and on.

7. The cooking apparatus as recited in claim 6, wherein the interruption of heating by said heating means is caused by an instantaneous suspension of a supply of power.

8. The cooking apparatus as recited in claim 6, wherein said heating chamber has at its one side a food inlet opening to put in said food, said apparatus further comprising:

a door attached to said food inlet opening; and opening detection means for detecting an opening of said door, wherein said control unit controls said heating means to stop heating when an opening of said door is detected by said opening detection means.

9. The cooking apparatus as recited in claim 5, wherein said infrared ray sensor is positioned to detect infrared rays radiated from said food diagonally from above.

* * * * *

UNITED STATES PATENT AND TRADEMARK OFFICE

CERTIFICATE OF CORRECTION

PATENT NO. : 5,919,389
DATED : July 6, 1999
INVENTOR(S) : Uehashi, et al.

It is certified that error appears in the above-identified patent and that said Letters Patent is hereby corrected as shown below:

On the title page item [54] and column 1, the title should be changed from "COOKING APPARATUS INCLUDING INFRARED RAY SENSOR" to read:

MICROWAVE COOKING APPARATUS INCLUDING TURNTABLE AND INFRARED RAY SENSOR

Signed and Sealed this

Twenty-first Day of December, 1999

*Attest:*

Q. TODD DICKINSON

*Attesting Officer*

*Acting Commissioner of Patents and Trademarks*